US008567352B2

(12) United States Patent
Kaupp

(10) Patent No.: US 8,567,352 B2
(45) Date of Patent: Oct. 29, 2013

(54) LOW MAINTENANCE FLUID HEATER AND METHOD OF FIRING SAME

(76) Inventor: Patrick A. Kaupp, Medicine Hat (CA)

( * ) Notice: Subject to any disclaimer, the term of this patent is extended or adjusted under 35 U.S.C. 154(b) by 925 days.

(21) Appl. No.: 12/701,667

(22) Filed: Feb. 8, 2010

(65) Prior Publication Data

US 2010/0132632 A1 Jun. 3, 2010

Related U.S. Application Data

(63) Continuation of application No. 11/726,481, filed on Mar. 22, 2007, now Pat. No. 7,681,536.

(51) Int. Cl.
*F22B 15/00* (2006.01)

(52) U.S. Cl.
USPC ..... 122/235.23; 122/235.14

(58) Field of Classification Search
USPC ..... 122/136 R, 135.3, 235.23, 248, 235.13, 122/235.14; 137/340, 360, 563
See application file for complete search history.

(56) References Cited

U.S. PATENT DOCUMENTS

| | | | | | |
|---|---|---|---|---|---|
| 1,160,870 | A | * | 11/1915 | Ford | 122/136 R |
| 2,123,444 | A | | 7/1936 | Thibaudeau | |
| 2,716,968 | A | | 9/1955 | Hess et al. | |
| 3,106,915 | A | | 10/1963 | Key | |
| 3,401,673 | A | * | 9/1968 | Key, Jr. | 122/250 R |
| 3,406,752 | A | | 10/1968 | Lion | |
| 3,920,067 | A | * | 11/1975 | Schindler et al. | 165/283 |
| 3,938,475 | A | * | 2/1976 | O'Sullivan et al. | 122/333 |
| 4,034,717 | A | * | 7/1977 | Clum et al. | 122/359 |
| 4,058,087 | A | | 11/1977 | Rehm | |
| 4,109,614 | A | | 8/1978 | Viessmann | |
| 4,192,259 | A | | 3/1980 | Viessmann | |
| 4,232,634 | A | * | 11/1980 | Terrell et al. | 122/41 |
| 4,387,669 | A | * | 6/1983 | Brown | 122/235.23 |
| 5,845,609 | A | * | 12/1998 | Corrigan | 122/209.1 |
| 6,052,898 | A | * | 4/2000 | Corrigan | 29/890.037 |
| 6,269,782 | B1 | | 8/2001 | Kayahara et al. | |
| 7,067,101 | B2 | | 6/2006 | Rameshni | |
| 2006/0127831 | A1 | | 6/2006 | Kagi | |

FOREIGN PATENT DOCUMENTS

| | | |
|---|---|---|
| CA | 342948 | 7/1934 |
| CA | 741680 | 8/1966 |
| CA | 2246026 | 3/1999 |
| CA | 2332934 | 12/1999 |
| CA | 2256854 | 6/2000 |
| EP | 1382403 | 1/2004 |

* cited by examiner

*Primary Examiner* — Gregory A Wilson
(74) *Attorney, Agent, or Firm* — Nelson Mullins Riley & Scarborough, LLP

(57) ABSTRACT

A fluid heater constructed of rectangular tubing through which fluid to be heated is circulated in a circuitous path. The floor and walls of a combustion chamber of the heater are constructed of the rectangular tubing. A tubular coil stack is positioned over the combustion chamber and surrounded by coil stack chamber walls constructed of the rectangular tubing. Consequently, all surfaces of the fluid heater exposed directly to flame are constantly cooled by the fluid to be heated. A combustion unit of the fluid heater is removable to facilitate maintenance.

20 Claims, 8 Drawing Sheets

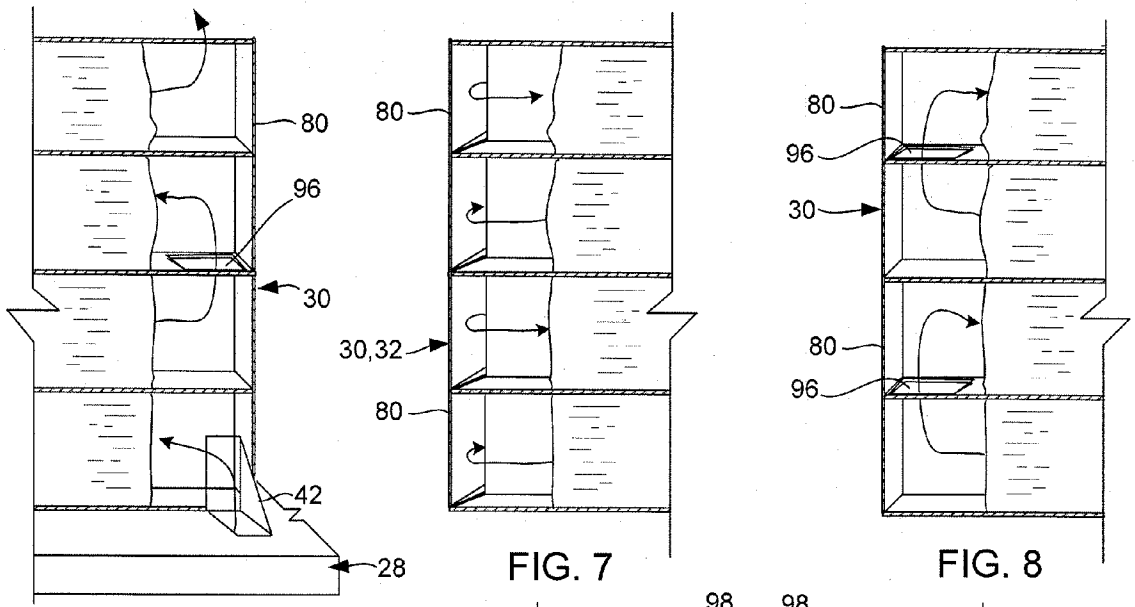
FIG. 6
FIG. 7
FIG. 8
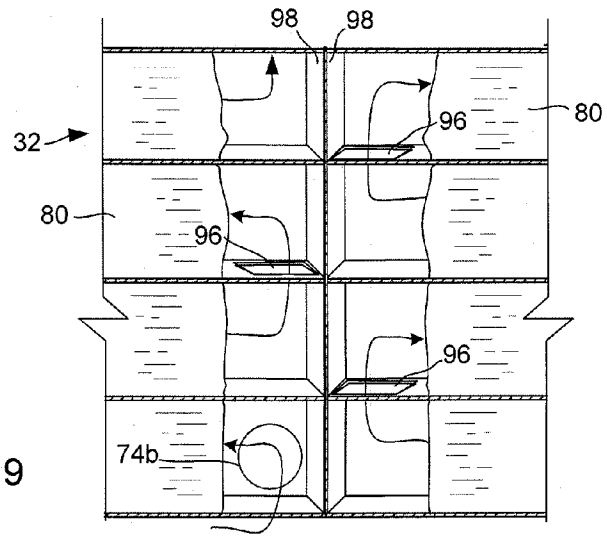
FIG. 9

LOW MAINTENANCE FLUID HEATER AND METHOD OF FIRING SAME

RELATED APPLICATIONS

This application is a continuation of U.S. patent application Ser. No. 11/726,481 filed Mar. 22, 2007.

FIELD OF THE INVENTION

This invention relates in general to boilers, and, in particular, to a low maintenance fluid heater with a removable burner unit to facilitate maintenance of the fluid heater.

BACKGROUND OF THE INVENTION

Boilers for heating water and other fluids for use in heating systems, industrial processes and the like are well known in the art. In general, such boilers employ a ceramic-lined or enamel-lined firebox where a fossil fuel is combusted to provide an energy source for heating the fluid to a desired temperature. The fluid is normally heated by circulating flue gases through a "water wall" formed of a plurality of pipes or channels through which the fluid is circulated.

For certain applications, fluid heaters for rapidly heating large volumes of water or other fluids are required. Such applications include the heating of hydrocarbon well fracturing fluids, which are generally but not exclusively aqueous fluids that are typically heated to about 15° C.-50° C. before they are injected into a hydrocarbon well. Portable heaters for this application must be lightweight, rugged, efficient and capable of high heat output. While fluid heaters of this type are known, they are expensive to construct and maintain, and are not necessarily capable of the heat generation required to rapidly heat large volumes of well fracturing fluids in the field.

There therefore exists a need for an efficient, low maintenance fluid heater.

SUMMARY OF THE INVENTION

It is therefore an object of the invention to provide a low maintenance fluid heater.

The invention therefore provides a fluid heater, comprising metal tubing edge-welded together to construct a floor and walls of a combustion chamber where fuel is combusted to heat a fluid circulated through the metal tubing.

The invention further provides a method of firing a fluid heater, comprising: supplying a heavy hydrocarbon fluid fuel to fluid fuel burners of a combustion unit of the fluid heater at a fluid pressure that is at least about double a manufacturer's recommended fuel supply pressure for the hydrocarbon fluid fuel burners; supplying combustion air to the hydrocarbon fluid fuel burners at a recommended supply rate and supply pressure; and supplying combustion air to the combustion chamber through a hollow floor of the combustion unit at a supply rate that is about equal to the supply rate for the burners.

The invention yet further provides a fluid heater, comprising: a combustion chamber floor constructed of rectangular steel tubing edge-welded together to form an uninterrupted flow path for fluid to be heated; combustion chamber walls mounted to the combustion chamber floor and forming three sides of a combustion chamber constructed of rectangular steel tubing edge-welded together to form an uninterrupted flow path in fluid communication with the flow path of the combustion chamber floor; and a removable combustion unit that forms a fourth side of the combustion chamber.

BRIEF DESCRIPTION OF THE DRAWINGS

Having thus generally described the nature of the invention, reference will now be made to the accompanying drawings, in which:

FIG. 6 is a schematic diagram of an end of a combustion chamber shown in FIG. 1 adjacent one side of a combustion unit of the fluid heater, showing the wall partially cut away to illustrate a fluid flow path through the wall;

FIG. 7 is a schematic diagram of an end of a combustion chamber shown in FIG. 1 remote from the combustion unit of the fluid heater, showing the wall partially cut away to illustrate a fluid flow path through the wall;

FIG. 8 is a schematic diagram an end of a combustion chamber shown in FIG. 1 adjacent the other side of the combustion unit, showing the wall partially cut away to illustrate a fluid flow path through the wall;

FIG. 9 is an isometric diagram of a reverse-flow corner of a coil stack chamber of the fluid heater shown in FIG. 1;

DETAILED DESCRIPTION OF THE PREFERRED EMBODIMENTS

The invention provides a fluid heater that is light weight, so it is easily transported; robust, so it has a long service life; modular, so it is quickly and easily maintained; adapted to burn a heavy hydrocarbon waste fuel, so it is economical to operate; and produces high heat output, so it is capable of quickly heating large volumes of fluid to a desired temperature. The floor and walls of the fluid heater are constructed entirely of rectangular metal tubing through which the fluid to be heated is circulated before it enters a coil stack positioned directly over a combustion chamber of the fluid heater. Consequently, all surfaces of the fluid heater exposed directly to flame are cooled by the fluid to be heated and efficiently transfer heat to that fluid. A combustion unit of the fluid heater is removable to permit maintenance of the combustion unit and the coil stack to be performed easily and efficiently.

Figure 1:
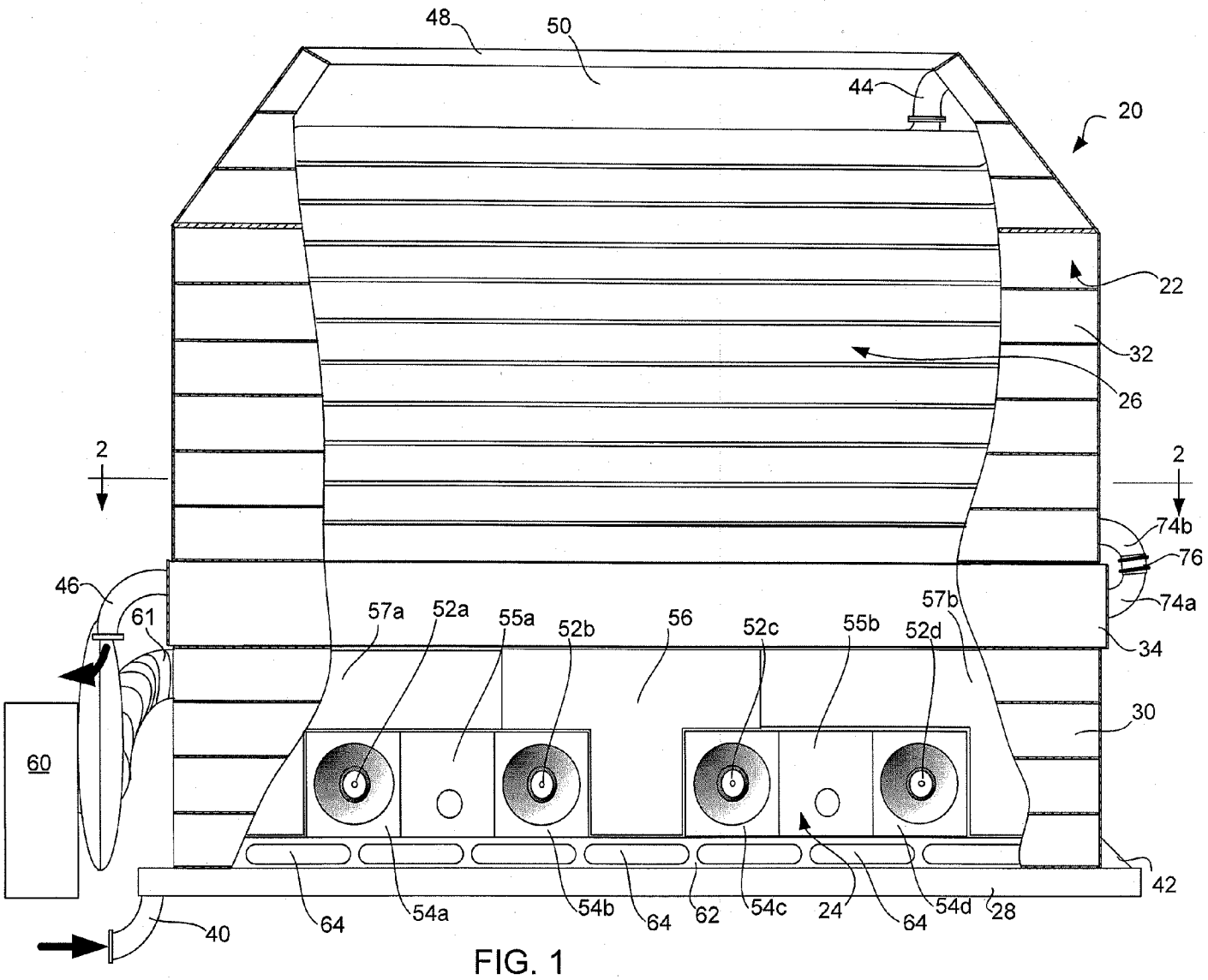
FIG. 1 is a schematic side elevational view of one embodiment of the fluid heater in accordance with the invention showing a facing sidewall partially cut away to illustrate a burner unit and coil stack of the fluid heater.

FIG. 1 is a schematic side elevational view of one embodiment of a fluid heater 20 in accordance with the invention, showing a facing sidewall 22 partially cut away to illustrate a burner unit, generally indicated by reference 24, and coil stack, generally indicated by reference 26, of the fluid heater 20.

In one embodiment outer walls of the fluid heater 20, which define a combustion chamber 30 in front of the combustion unit 24 and a coil stack chamber 32 that surrounds the coil stack 26 are a substantially square structure constructed entirely of rectangular tubular steel of an appropriate gauge and composition dependent on a corrosiveness of the fluid to be heated. A floor 28 of the fluid heater 20 is also constructed of the same rectangular tubular steel material. In one embodiment, the floor 28 and outer walls 30, 32 of the fluid heater 20 are constructed of 2"×6" (5 cm×15 cm) rectangular tubular steel, with an exception of a coil stack support beam 34, which in one embodiment is constructed of an 8"×8" (20 cm×20 cm) square tubular steel.

Fluid to be heated is pumped in to an inlet pipe 40 welded to a bottom edge of the floor 28 and circulated along a circuitous path through the floor to an opposite side of the floor 28, as will be explained below with reference to FIG. 5. The fluid is then circulated up through a conduit 42 into the sidewall of the combustion chamber 30 adjacent the combustion unit 24. The fluid again follows a circuitous path around the outer walls of the combustion chamber 30 and the coil stack support beam 34, as will be explained below with reference to FIGS. 6-8, until it enters tubular conduits 74*a*, 74*b* interconnected by a removable joint 76, which conducts the fluid from the coil stack support beam to the bottom of the coil stack chamber wall 32. The removable joint 76 permits the coil stack chamber 32 to be removed from the fluid heater 20 to provide access to the coil stack 26, if required. The fluid to be heated travels in a circuitous path around the coil stack chamber wall 32, as will be explained below with reference to FIG. 9, until it enters a conduit 44 welded to a top of the coil stack chamber wall 32. The fluid then circulates through the coil stack 26, as will be explained below with reference to FIG. 2, and exits the fluid heater 20 via an outlet pipe 46 routed through a side of the coil stack support beam 34 and connected to, for example, a storage tank from which the fluid to be heated was pumped.

As it is apparent, a top of the coil stack chamber 32 is inwardly inclined. In one embodiment, the inward inclination is at an angle of about 45°. A top edge 48 of the coil stack chamber 32 defines a rectangular flue gas vent 50 through which flue gases produced by the burner unit 24 are exhausted after they rise through the closely spaced and overlapping coils of the coil stack 26, as will likewise be explained below in more detail with reference to FIG. 2.

The burner unit 24 includes a plurality of burners. In this embodiment, the burner unit 24 includes 4 burners 52*a*-52*d*. In one embodiment, each of the burners 52*a*-52*d* are manufactured by the Hauck Manufacturing Company located in Lebanon, Pa., USA, and designed to burn a heavy hydrocarbon waste fuel, such as used engine lubricating oil. However, the burners 52*a*-52*d* may be designed to burn any carbonaceous fluid fuel, including gaseous fuels, such as propane or natural gas. Each burner head is located in the back of a ceramic cone 54*a*-54*d*, into which atomized fuel is ejected by the respective burner heads in a manner well known in the art. Located between each pair of burners 54*a*, 54*b* and 54*c*, 54*d* is a fuel preheating chamber 55*a*, 55*b* as will be explained below in more detail with reference to FIG. 11. For practical reasons, an outer wall of the burner unit 24 is not cooled by the fluid to be heated. Consequently, sacrificial steel plates are hung about 1" (2.5 cm) in front of the outer wall of the burner unit 24 by pins (not shown) connected to the outer wall of the burner unit 24. In this embodiment, three sacrificial plates are used. A center T-shaped plate 56 and two L-shaped side plates 57*a*, 57*b*. The sacrificial plates are replaced as required and provide heat protection required by the burners and other components of the burner unit 24, which will be described below in more detail with reference to FIG. 10.

In operation, pressurized combustion air is supplied to the burner unit 24 by a blower 60, also available from Hauck Mfg. Co., which delivers the pressurized combustion air to the burner unit 24 through a combustion air supply pipe 61. As will be explained below in more detail with reference to FIG. 10, the combustion air is distributed in equal proportion to the burners 52*a*-52*d* and to a hollow floor 62 of the combustion unit 24. The combustion air delivered to the hollow floor 62 is exhausted into the combustion chamber through a plurality of oblong slots 64, supplying extra combustion air to the combustion chamber 30. This permits fuel to be delivered to the burners at twice the manufacturer's recommended fuel pressure, i.e. 80 psi rather than 40 psi. In this way, the BTU output of the burner unit is nearly doubled and the efficiency of the fluid heater 20 is greatly improved in comparison to an efficiency of known units of the same type.

Figure 2:
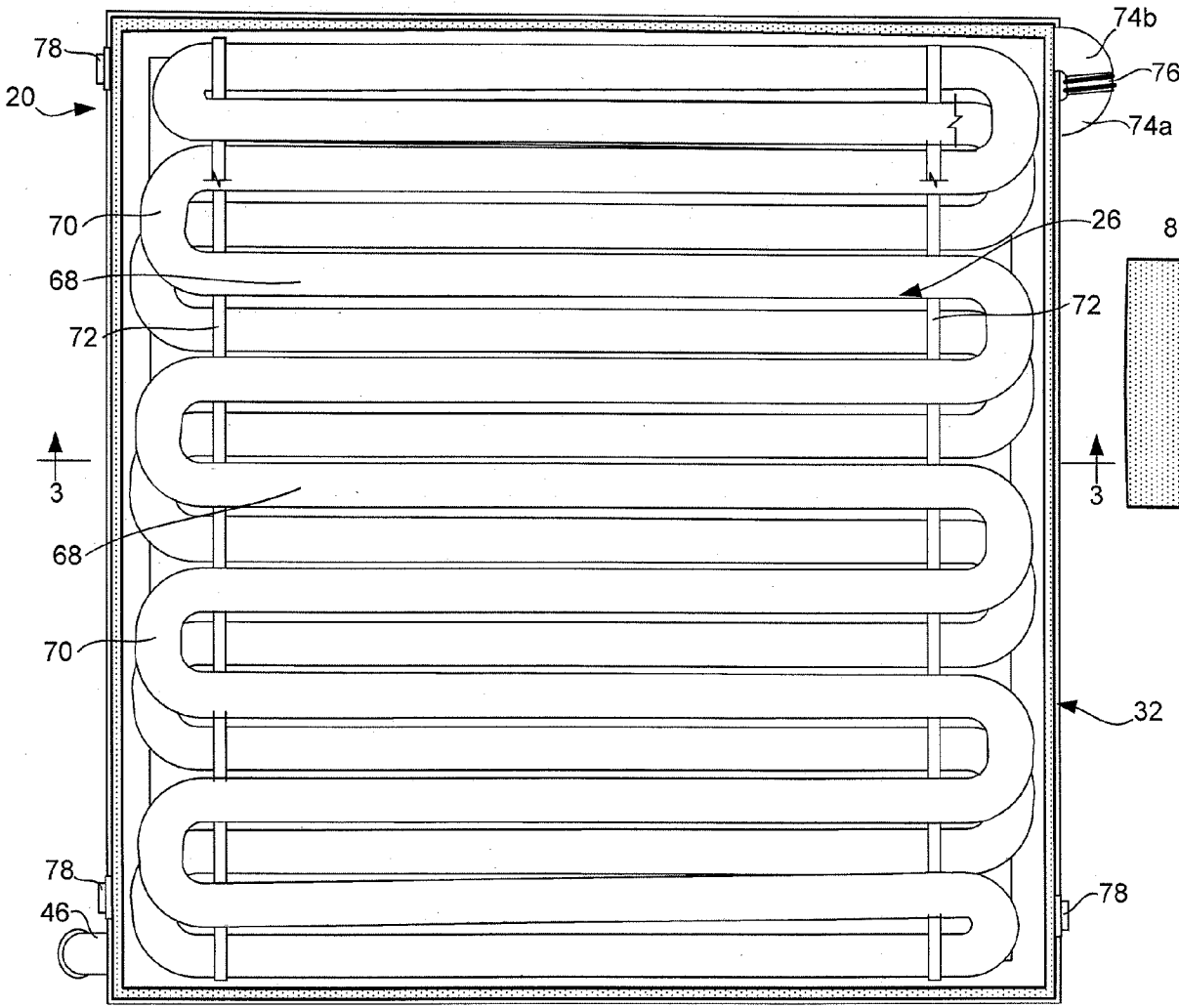
FIG. 2 is a schematic top plan view of a part of the coil stack of the fluid heater taken along lines 2-2 of FIG. 1.

FIG. 2 is a schematic top plan view of a lower part of the coil stack 26 of the fluid heater 20, taken along lines 2-2 of FIG. 1. In one embodiment of the fluid heater 20, the coil stack 26 has 9 pipes 68 in each layer interconnected by U-shaped) (180° elbows 70, and is 11 layers high. The pipes 68 and the elbows 70 are 3" (7.5 cm) in diameter and made of steel. Each layer of coils in the coil stack 26 is separated by 1"×0.5" (2.5 cm×1.25 cm) flat steel bar stock 72 that is welded to each end of each pipe 68. As is apparent, the coils in each layer of the coil stack are staggered with respect to the layer immediately below and the layer immediately above, so that flue gas must follow a circuitous path upward through the 11 layers of the coil stack before it exits through the flue gas vent 50 (see FIG. 1). This ensures that heat energy is efficiently extracted from the flue gas, while facilitating cleaning of the coil stack 26. Cleaning of the coil stack is accomplished by directing compressed air and/or high-pressure water through the coil stack 26 via the flue gas vent 50 (see FIG. 1) after the burner unit 24 is removed from the combustion chamber, as will be explained below in more detail with reference to FIG. 4.

As explained above, the coil stack support beam 34 is connected to the combustion chamber wall 32 by the interconnected conduit 74*a*, welded to a circular opening in an outer side of one end of the combustion chamber support beam 34 (see FIG. 1), and the conduit 74*b* welded to a circular opening in a bottom of the coil stack chamber wall 32 to permit the coil stack chamber to be removed, if required. A plurality of fasteners 78 connect the coil stack chamber wall 32 to the coil stack support beam 34, as will be explained below in more detail with reference to FIG. 3.

Figure 3:
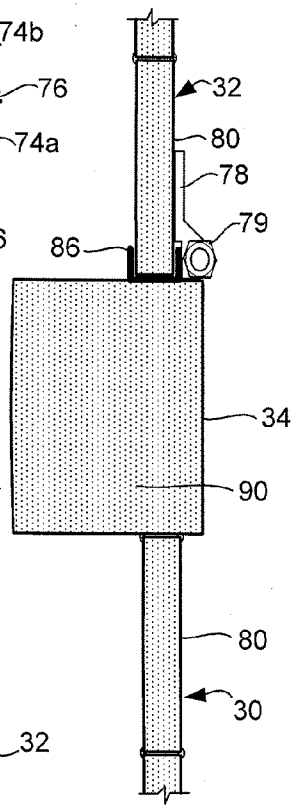
FIG. 3 is a schematic cross-sectional view of the fluid heater wall construction in accordance with the invention, taken along lines 3-3 of FIG. 2.

FIG. 3 is a schematic cross-sectional view of the fluid heater wall construction in accordance with the invention, taken along line 3-3 of FIG. 2. As explained above, both the combustion chamber wall 30 and the coil stack chamber wall 32 are constructed of a 2"×6" rectangular steel tubing 80. Fluid 90 to be heated is circulated through the combustion chamber wall 30, the coil stack support beam 34 and the coil stack chamber wall 32, as explained above with reference to FIG. 1. In one embodiment of the fluid heater 20, a channel iron 86 is welded along an outer edge of a top of the coil stack support beam 34 to removably support a bottom edge of the coil stack chamber wall 32. As will be explained above, the fasteners 78 retain the bottom of the coil stack chamber wall in the channel iron 86. In one embodiment, the latches receive bolts 79 that are removed when the coil stack chamber wall must be removed from the fluid heater 20.

Figure 4:
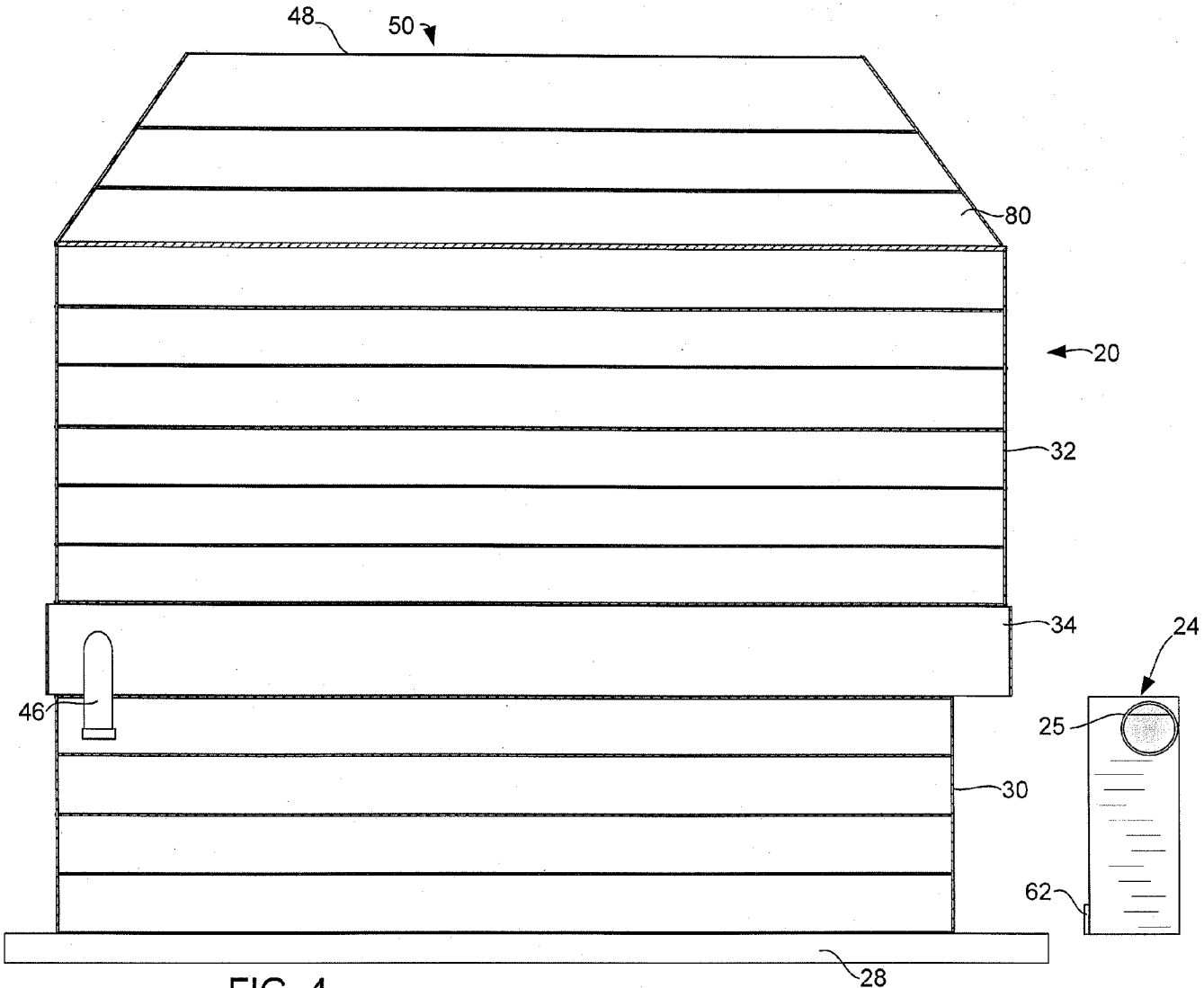
FIG. 4 is a schematic front elevational view of the fluid heater shown in FIG. 1, with the combustion unit removed for maintenance.

FIG. 4 is a schematic rear elevational view of the fluid heater 20 shown in FIG. 1, with the combustion unit 24 removed for maintenance. When the combustion unit 24 requires maintenance or the coil stack 26 requires cleaning, the combustion air supply pipe 61 (see FIG. 1) is disconnected from a combustion air inlet 25, which will be described below with reference to FIG. 10. Fasteners that connect the combustion unit 24 (not shown) to the fluid heater 20 are then removed and the combustion unit 24 is removed from the fluid heater 20. Since the floor 28 and walls 30 of the combustion chamber are all constructed of steel continuously cooled by the fluid being heated, and the combustion chamber is not lined with refractory cement or other insulation material, the only maintenance required in the combustion chamber is occasional ash removal. With respect to the combustion unit 24, the ceramic cones 54*a*-54*d* occasionally require replacement and nozzles of the burner heads 52*a*-52*d* require the maintenance well known in the art. However, this maintenance is readily and quickly accomplished after the burner unit 24 is removed from the fluid heater 20.

Figure 5:
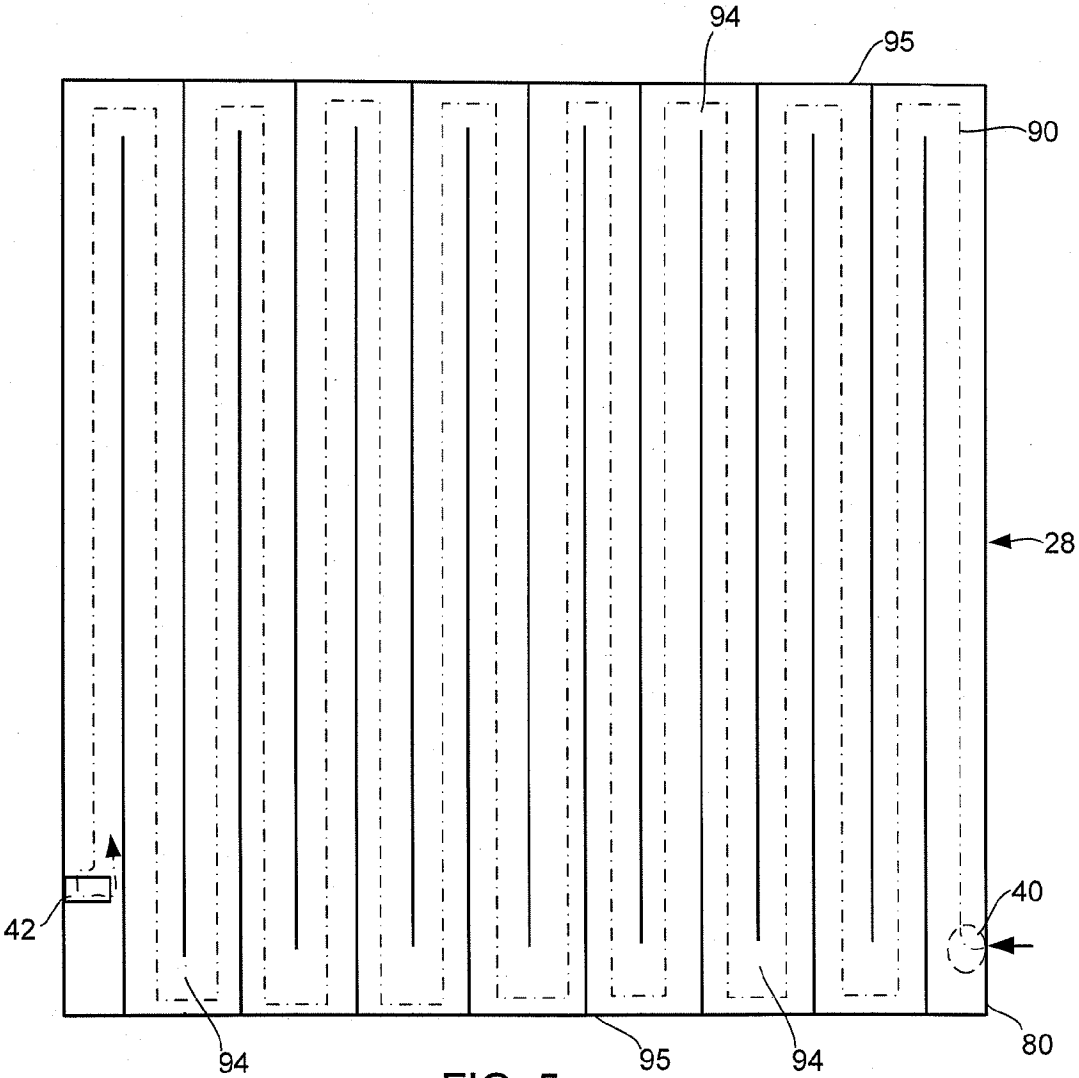
FIG. 5 is a schematic diagram of a plan view cross-section of an exemplary floor construction for the fluid heater in accordance with the invention, showing an exemplary flow path through the floor for fluid to be heated.

FIG. 5 is a schematic diagram of a top plan cross-section of an exemplary construction for the combustion chamber floor 28 of the fluid heater 20, showing an exemplary flow path through the floor 28 for fluid to be heated. As explained above, the floor 28 is constructed of a plurality of rectangular steel tubings 80 that are edge-welded together to construct a flat floor that is about 2" thick. A 6" long rectangular slot 94 is cut in opposite sides of each end of the sidewalls of the rectangular tubings 80, to form a flow path 94 between the adjacent rectangular steel tubings 80 after they are edge welded together. A steel plate 95 is welded across the respective open ends of the rectangular steel tubings 80. The inlet pipe 40 is welded to a 3" (7.5 cm) circular hole cut in one side of the bottom of the floor 28, as explained above with reference to FIG. 1. The position and orientation of the inlet pipe 40 permits all fluid to be drained from the fluid heater 20 to prevent damage due to freezing or corrosion after a fluid heating job is completed. A rectangular slot is cut in an opposite top side of the floor 28 and the conduit 42 is welded to a perimeter of that rectangular slot to provide fluid communication with the fluid flow path through the combustion chamber wall 30, as explained above with reference to FIG. 1. The fluid 90 to be heated is pumped through the inlet pipe 40 and circulates at a substantially constant flow rate through the circuitous path shown until it flows through the conduit 42 and enters a bottom of the combustion chamber wall 30 (see FIG. 1).

FIG. 6 is a schematic diagram of an end of the combustion chamber wall 30 shown in FIG. 1, adjacent one side of the combustion unit 24 of the fluid heater 20. The combustion chamber wall 30 is shown partially cut away to illustrate the fluid flow path through the wall. As explained above, fluid leaves the floor 28 via the conduit 42 and enters a bottom of the combustion chamber wall 30. The rectangular steel tubings 80 are edge-welded together to form the combustion chamber wall 30. Rectangular slots 96 that are about 6" (15 cm) long are cut in the sidewalls of adjacent rectangular steel tubings 80 to provide a flow path between the respective rectangular steel tubings 80. At a top of the combustion chamber wall 30, the fluid to be heated enters the coil stack support beam 34 (not shown).

FIG. 7 is a schematic diagram of an end of the combustion chamber wall 30 shown in FIG. 1 remote from the combustion unit 24 of the fluid heater 20, showing the combustion chamber wall 30 partially cut away to illustrate the fluid flow path around those corners of the wall 30. As can be seen, the corners are mitered and butt-welded to provide an uninterrupted flow path around the corner for the fluid 90 to be heated. This same construction is used for the corners of the coil stack chamber 32, with the exception of one corner, which is a reverse-flow corner shown in FIG. 9 and described below.

FIG. 8 is a schematic diagram an end of the combustion chamber wall 30 shown in FIG. 1 adjacent the opposite side of the combustion unit 24 of the fluid heater 20, showing the wall partially cut away to illustrate a fluid flow path through the wall 30. This side of the combustion chamber wall 30 is constructed essentially the same as the opposite side shown in FIG. 6, except that the slots 96 are cut in opposite sidewalls of each rectangular steel tubing 80.

FIG. 9 is an isometric diagram of a reverse-flow corner of the coil stack chamber wall 32 of the fluid heater 20 shown in FIG. 1. In one embodiment of the fluid heater 20, the reverse flow corner is located above the fluid conduit 42. As explained above, the fluid to be heated enters a bottom of the coil stack chamber wall through the conduit 74*b* (see FIGS. 1 and 2). In the reverse flow corner, the rectangular steel tubings 80 are mitered as explained above. However, a steel plate 98 is welded between the mitered ends to block fluid flow between those ends. Otherwise, the reverse-flow corner is constructed on one side as shown in FIG. 6 and on the other side as shown in FIG. 8.

As seen in FIGS. 6-9, the fluid to be heated travels a circuitous path through the walls of the fluid heater 20 around the combustion chamber wall 30 and the coil stack chamber wall 32 at a substantially constant velocity due to the consistent cross-sectional area of the flow path. Although not shown, a rectangular slot 96 is cut in the bottom side of the coil stack support beam 34 to provide a fluid flow path from the top rectangular steel tubing 80 in the combustion chamber wall 30. Alternatively, a conduit (not shown) is used to provide a fluid path from the combustion chamber wall 30 to the coil stack support beam. A partition (not shown) is butt-welded in the mitered corner of the coil stack support beam 34 between the two rectangular slots, in a similar way to that described above with reference to FIG. 9.

Figure 10:
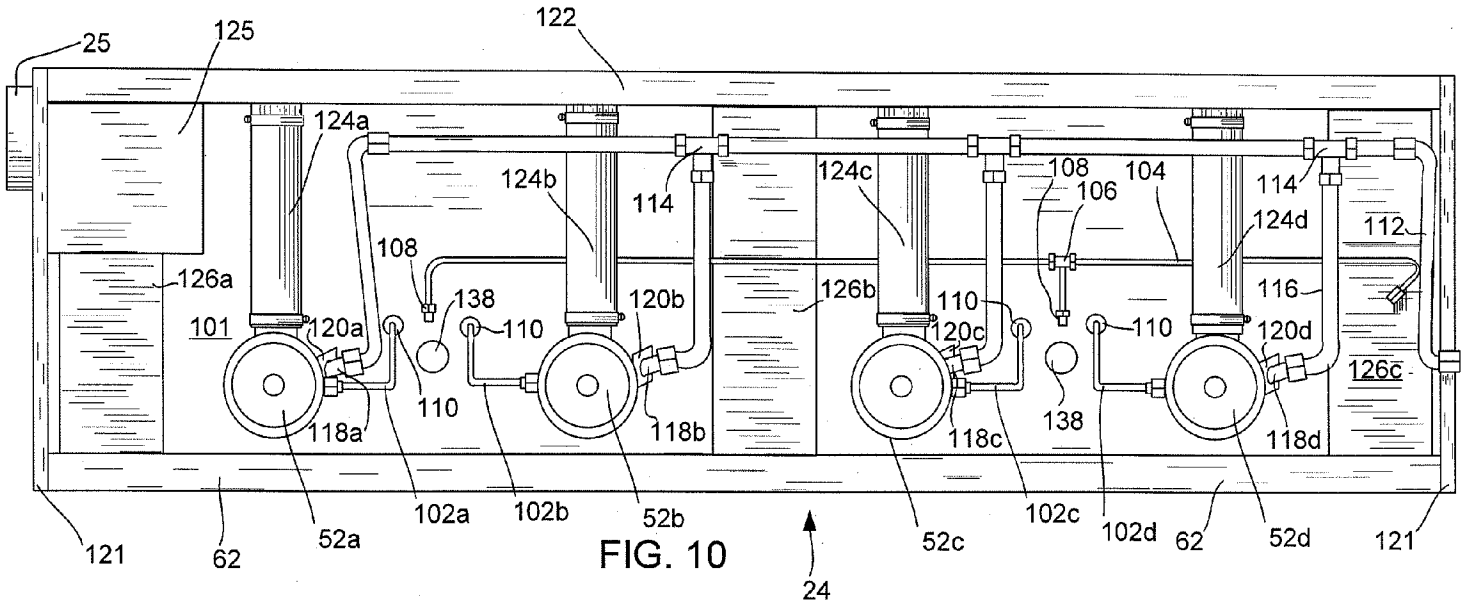
FIG. 10 is a schematic diagram of an outer side of an exemplary combustion unit for the fluid heater shown in FIG. 1.

FIG. 10 is a schematic diagram of an outer side of an exemplary combustion unit 24 for the fluid heater 20. As explained above with reference to FIG. 1, in this embodiment the combustion unit 24 includes four burners 52*a*-52*d* mounted to an outer wall 101 of the combustion unit 24. Each burner 52*a*-52*d* is supplied with pressurized fuel from one of the fuel preheating chambers 55*a*, 55*b* (see FIG. 1) by a fuel line 102*a*-102*d*. The fuel is supplied from a fuel tank, as will be explained below with reference to FIG. 13, by a fuel supply line 104. A fitting 106 branches to a fitting 108 which is connected to the fuel preheating chamber 55*a*. A similar fitting 108 connects the fuel line 104 to the fuel preheating chamber 55*b*. Fittings 110 connect the respective fuel lines 102*a*-102*d* to the respective fuel preheating chambers 55*a*, 55*b*.

As will be understood by those skilled in the art, a waste fuel burner requires some way of igniting the burners 52*a*-52*d*. Consequently, the burner unit 24 includes a gaseous fuel ignition system, in one embodiment a propane ignition system. Propane fuel is supplied via a propane fuel line 112 connected to a propane fuel tank and regulator (not shown). Fittings 114 branch to propane burner fuel supply lines 116 connected to propane burners 118, which are secured to ports 120*a*-120*d* that respectively support the propane burners 118*a*-118*d* in an orientation so that flame output from the respective propane burners 118*a*-118*d* is directed into the respective ceramic cones 54*a*-54*d* (see FIG. 1). Once the respective burners 52*a*-52*d* are ignited, the propane burners 118*a*-118*d* are extinguished.

Combustion air is supplied to the combustion unit 24 through the combustion air input 25 to a combustion air distribution chamber 125 connected to a combustion air distribution box 122. In the one embodiment, the combustion air distribution box 122 is a 3"×8" (7.5 cm×20 cm) rectangular steel tubing. As explained above, the combustion air supply pipe 61 connects to the combustion air input 25. Pressurized combustion air is supplied from the combustion air distribution box 122 to the respective burners 52*a*-52*d* by respective combustion air supply lines 124*a*-124*d*. A volume of compressed combustion air that is substantially equal to the volume delivered collectively to the burners 52*a*-52*d* is delivered by rectangular combustion air supply channels 126*a*-126*c* (in one embodiment 6"×2" (15 cm×5 cm) steel channels welded to the combustion chamber wall 101) to the hollow combustion unit floor 62, as explained above with reference to FIG. 1. The combustion wall 101 and the combustion unit floor 62 are thus further cooled by the combustion air, while the combustion air is preheated to improve efficiency of the waste fuel burn. Steel plates 121 welded to opposite ends of the combustion air distribution box 122 and the combustion unit floor 62 provide rigidity required to permit the combustion unit 24 to be removed from the fluid heater 20, and handled as required.

Figure 11:
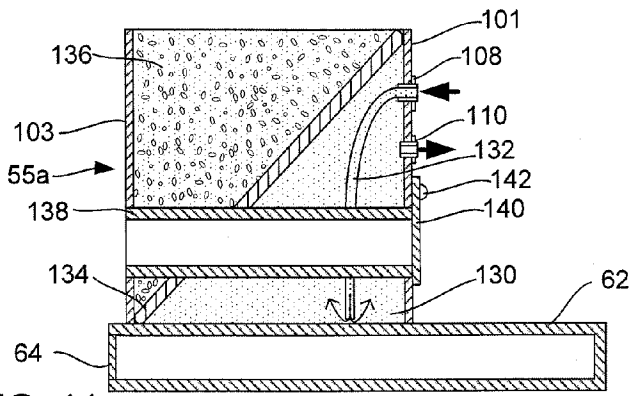
FIG. 11 is a schematic cross-sectional diagram of a fuel preheater for the fluid heater in accordance with the invention.

FIG. 11 is a schematic cross-sectional diagram of one embodiment of the fuel preheater 55*a* of the combustion unit 24. The fuel preheater 55*b* is identically constructed. As described above, fitting 108 connects the pressurized fuel supply line 104 to the fuel preheater 55*a*. A fuel delivery line 132 delivers fuel 132 a bottom of a fuel preheating chamber. The fuel rises as it is heated and exits through fitting 110 to one of the fuel lines 102*a*-102*b*. The fuel preheater 55*a* is a box constructed of steel plate. The front of the fuel preheater chamber 55*a* is formed by the outer wall 101 of the combustion unit 24. A steel plate 134 is welded diagonally across the steel box to divide it into two chambers, a fuel preheat chamber and an insulation chamber that is filled with a ceramic fire segment 136 to prevent the fuel from overheating. A sight tube 138 pierces the front wall 101, the steel plate 134 and a rear wall 103 of fuel preheater 55*a*. The sight tube optionally has a cover 140 pivotally supported by a pivot pin 142. The sight tube 138 permits an operator of the combustion unit 24 to observe the combustion chamber of the fluid heater 20.

Figure 12:
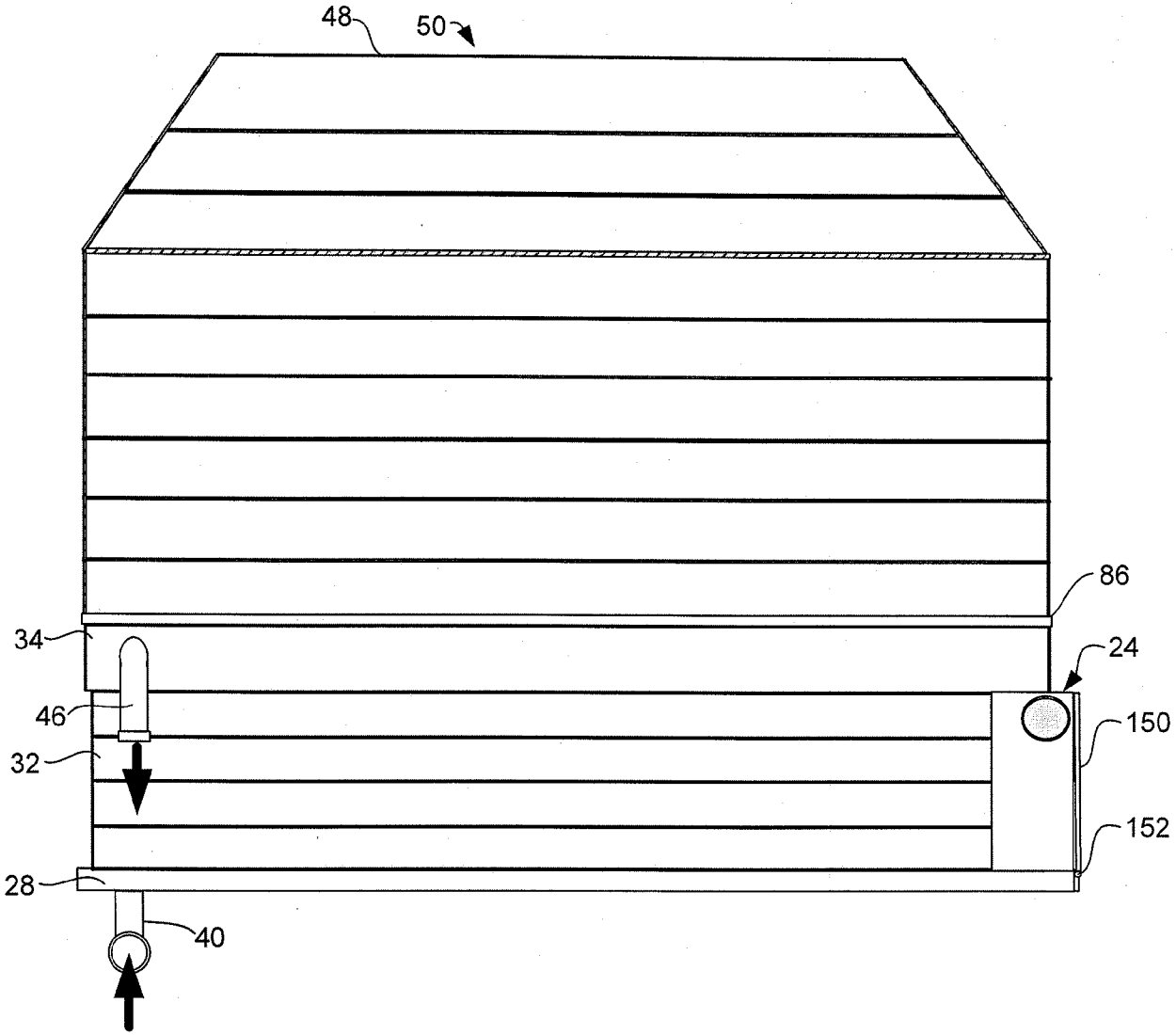
FIG. 12 is a schematic front elevational view of the fluid heater shown in FIG. 4, with the combustion unit in an operative position.

FIG. 12 is a schematic front end elevational view of the fluid heater 20 shown in FIG. 4, with the combustion unit 24 in an operative position. In one embodiment, the fluid heater 20 has a panel 150 hinged to a side of the combustion chamber floor by one or more hinges 152. When not in use and during transport, the panel 150 covers the outer side of the combustion unit 24 to protect the burners 52*a*-52*d*, fuel lines 104, 112, etc. The panel 150 is secured in the closed position by latches (not shown).

Figure 13:
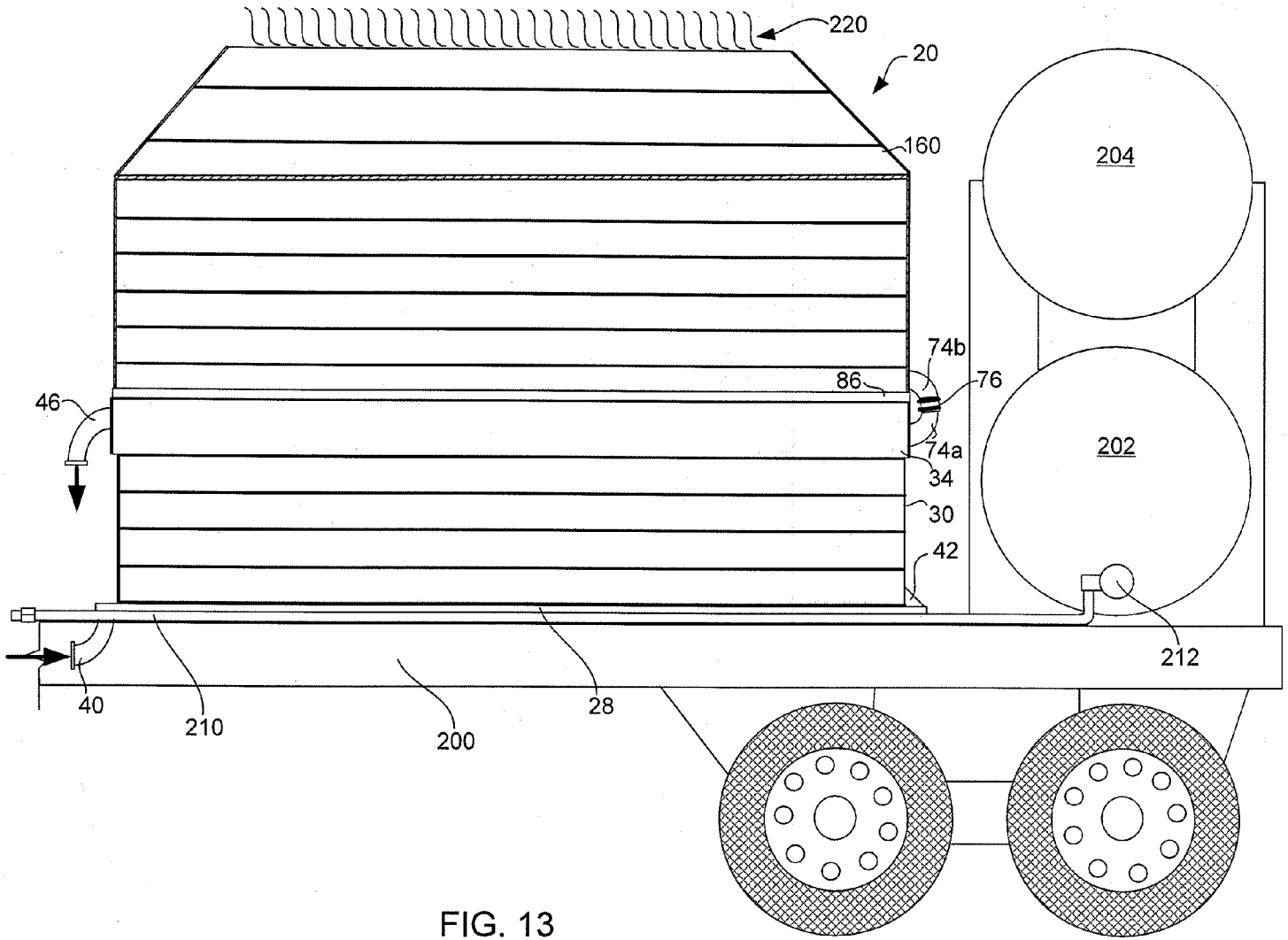
FIG. 13 is a schematic side elevational view of the fluid heater mounted to a truck bed, with fuel tanks in accordance with a further aspect of the invention.

FIG. 13 is a schematic side elevational view of the fluid heater 20 mounted to a truck bed 200, equipped with a fuel tank 202 in accordance with a further aspect of the invention. Since the fluid heater 20 is designed to burn used engine oil, and since such fuels have to be preheated in order to sustain combustion, the fuel tank 202 in accordance with the invention is designed to heat the fuel above a required combustion temperature, i.e. 140° F. for waste engine oil. Consequently, an insulated heater line 210 is connected to hollow sealed tube 212 constructed of a 5" (12.5 cm) steel tube (not shown) welded inside the hollow sealed tube 212, which is 6" (15 cm) in diameter. The hollow sealed tube 212 extends through a bottom of the fuel tank 202. The insulated heater line 210 is equipped with fittings for connecting it to the engine cooling system of a truck engine (not shown) of a truck with the truck bed 200. The insulated heater line 210 is filled with engine coolant fluid that is circulated through an annular space between the inner tube and the hollow sealed tube 212 when the truck engine is operating. A return line (not shown) forms an endless loop with the engine cooling system. A side port inlet (not shown) at one end of the hollow sealed tube 212 inside the tank extends through the annular space between the hollow sealed tube and the inner tube and delivers fuel from the fuel tank 202 to the inner tube. The fuel supplied to the burners 52*a*-52*d* enters the inner tube through the side port. The fuel travels through the inner tube and is preheated to about 140° F. before it enters a fuel supply line (not shown) that is in turn connected to the fuel supply line 104 of the combustion unit 24. In one embodiment of the invention, the fuel tanks 202 and 204 are pressurized with compressed air to deliver fuel to the burners 52*a*-52*d* at the desired 80 psi. For clarity of illustration, none of the auxiliary equipment such as the blower 60, etc. is shown in FIG. 13.

In summary, as explained above, during use of the fluid heater 20: fluid to be heated is pumped in through the inlet pipe 40; follows the circuitous path through the combustion chamber floor 28; enters the combustion chamber wall 13 through the conduit 42; follows the circuitous path through the combustion chamber wall and enters the coil stack support beam 34; circulates through the coil stack support beam 34 and enters the coil stack chamber wall 32 through the conduits 74*a*, 74*b* (see FIG. 1); follows the circuitous path through the coil stack chamber wall 32 to the tubular conduit 44 where the fluid enters the top of the coil stack 26 and circulates down through the coil stack 26 to the outlet pipe 46 where it is returned to the storage tank (not shown). Flue gas 220 produced by fuel combusted by the combustion unit 24 is exhausted through a top of the coil stack cover 160. Consequently, all surfaces of the fluid heater 20 that are directly exposed to flame are continuously cooled by the fluid to be heated. As a result, the only maintenance required for all components except the combustion unit 24 is the removal of ash as required. As explained above, this is readily accomplished using compressed air and/or water after the combustion unit 24 is removed. If the coil stack 26 ever requires more thorough maintenance, the coil stack chamber wall 32 can be removed by disconnecting the fasteners 79 (FIG. 3) and the conduit joint 76 and hoisting coil stack chamber wall 32 off of the fluid heater 20 to provide full access to the coil stack 26.

Although the invention has been described with reference to specific embodiments in which specific configurations of tubing have been used, it will be understood in the art that a fluid heater in accordance with the invention can also be constructed using cylindrical, hexagonal or octagonal tubing, or any combination of square, rectangular, round, pentagonal, hexagonal or octagonal tubing without departing from a spirit or scope of the invention.

Furthermore, although the invention has been described with specific reference to a portable fluid heater, the fluid heater in accordance with the invention is equally adapted for use in stationary applications and provides all of the above-noted advantages of being robust and easily maintained whether it is used for a stationary or a portable application.

The embodiments of the invention described above are therefore intended to be exemplary only. The scope of the invention is intended to be limited solely by the scope of the appended claims.

I claim:

1. A fluid heater, comprising:

metal tubing edge-welded together to construct a combustion chamber floor, a combustion chamber wall mounted to the combustion chamber floor that forms three sides of a combustion chamber with a fourth side formed by a combustion unit, and a coil stack chamber wall that forms four sides of the coil stack chamber above the combustion chamber; and a coil stack supported within the coil stack chamber through which flue gas is exhausted from the combustion chamber;

whereby, the edge-welded metal tubing of the combustion chamber floor, the combustion chamber wall and the coil stack chamber and the coil stack provide an uninterrupted flow path between an inlet and an outlet for the fluid to be heated.

2. The fluid heater as claimed in claim 1 wherein the metal tubing comprises steel tubing.

3. The fluid heater as claimed in claim 2 further comprising a coil stack support beam welded to a top of the combustion chamber wall and supporting both the coil stack chamber wall and the coil stack.

4. The fluid heater as claimed in claim 3 wherein the coil stack support beam comprises steel tubing.

5. The fluid heater as claimed in claim 1 wherein the coil stack comprises pipes interconnected by U-shaped elbows.

6. The fluid heater as claimed in claim 1 wherein the coil stack chamber wall defines a flue gas vent.

7. The fluid heater as claimed in claim 1 wherein the combustion unit comprises a removable combustion unit.

8. The fluid heater as claimed in claim 7 wherein the combustion unit comprises a plurality of fluid fuel burners supported by an outer wall of the removable combustion unit.

9. The fluid heater as claimed in claim 8 wherein the removable combustion unit further comprises a hollow floor cooled by combustion air exhausted into the combustion chamber.

10. The fluid heater as claimed in claim 9 wherein the removable combustion unit further comprises:

a combustion air distribution box at a top of the outer wall;

a plurality of combustion air lines and combustion air channels for respectively distributing combustion air in substantially equal proportions from the combustion air distribution box to the respective fluid fuel burners and the hollow combustion unit floor.

11. The fluid heater as claimed in claim 10 further comprising a gaseous fuel ignition system for igniting the fluid fuel burners.

12. The fluid heater as claimed in claim 8 further comprising at least one fluid fuel preheating chamber that preheats the fluid fuel before the fluid fuel is supplied to the fluid fuel burners.

13. The fluid heater as claimed in claim 12 further comprising a fluid fuel tank that preheats the fluid fuel before the fluid fuel is delivered to the at least one fluid fuel preheating chamber.

14. A fluid heater, comprising:

a combustion chamber floor constructed of rectangular steel tubing edge-welded together to form an uninterrupted, circuitous flow path through which fluid to be heated is pumped;

combustion chamber walls mounted to the combustion chamber floor and forming three sides of a combustion chamber constructed of rectangular steel tubing edge-welded together to form an uninterrupted, circuitous flow path in fluid communication with the uninterrupted, circuitous flow path through the combustion chamber floor;

a removable combustion unit that forms a fourth side of the combustion chamber;

a coil stack support beam mounted to a top of the combustion chamber walls and in fluid communication with the uninterrupted, circuitous flow path through the combustion chamber walls;

a coil stack chamber mounted to a top of the coil stack support beam and constructed of rectangular steel tubing edge-welded together to form an uninterrupted circuitous flow path in fluid communication with the flow path through the coil stack support beam;

a coil stack supported by the coil stack support beam within the coil stack chamber, the coil stack being constructed of steel pipes interconnected by U-shaped elbows, one end of the coil stack being in fluid communication with the uninterrupted, circuitous flow path through the coil stack chamber;

an inlet for the fluid to be heated connected to the combustion chamber floor; and an outlet for the fluid to be heated connected to the other end of the coil stack.

15. The fluid heater as claimed in claim 14 wherein the inlet for the fluid to be heated is connected to a bottom of the combustion chamber floor.

16. The fluid heater as claimed in claim 14 wherein the outlet for the fluid to be heated is routed through a side of the coil stack support beam.

17. The fluid heater as claimed in claim 14 wherein the removable combustion unit comprises:

a hollow combustion unit floor;

an outer combustion unit wall that supports a plurality of burners that respectively extend through the outer combustion unit wall and into the combustion chamber;

a fluid fuel preheater that preheats fluid fuel for the burners supported by the combustion unit floor inside the outer combustion unit wall;

a combustion air distribution box mounted to a top of the outer combustion unit wall;

a combustion air supply hose for each of the respective burners connected to the combustion air distribution box; and at least two combustion air supply channels for the hollow combustion unit floor connected to the combustion air supply box to deliver combustion air through the hollow combustion unit floor to the combustion chamber at a rate substantially equal to a rate at which combustion air is supplied collectively to the burners.

18. The fluid heater as claimed in claim 14 mounted to a truck bed.

19. The fluid heater as claimed in claim 18 further comprising a fuel tank mounted to the truck bed for supplying fuel to the burners, the fuel tank including a fuel preheating system for preheating heavy hydrocarbon waste fuel supplied to the fluid fuel preheater.

20. A fluid heater, comprising:

a combustion chamber floor constructed of rectangular steel tubing edge-welded together to form an uninterrupted flow path through which fluid to be heated is circulated;

three combustion chamber walls welded to the combustion chamber floor to form an uninterrupted flow path in fluid communication with the uninterrupted flow path through the combustion chamber floor;

a removable combustion unit that forms a fourth side of a combustion chamber defined by the combustion chamber floor, the combustion chamber walls and the removable combustion unit;

a coil stack support beam mounted to a top of the combustion chamber walls in fluid communication with a top of one of the combustion chamber walls;

a coil stack chamber mounted to a top of the coil stack support beam in fluid communication with a flow path through the coil stack support beam;

a coil stack supported by the coil stack support beam within the coil stack chamber having one end in fluid communication with a top of the coil stack chamber;

an inlet for the fluid to be heated connected to one side of the combustion chamber floor; and an outlet for the fluid to be heated connected to the other end of the coil stack.

* * * * *